United States Patent [19]

Clements

[11] 4,295,610

[45] Oct. 20, 1981

[54] IRRIGATION SPRINKLERS

[76] Inventor: Lloyd W. Clements, 49 W. Lincoln Ave., Woodland, Calif. 95695

[21] Appl. No.: 954,222

[22] Filed: Oct. 24, 1978

Related U.S. Application Data

[63] Continuation-in-part of Ser. No. 786,987, Apr. 13, 1977, abandoned.

[51] Int. Cl.[3] ..... B05B 3/02

[52] U.S. Cl. ..... 239/230; 239/546; 285/281

[58] Field of Search ..... 285/275, 278, 281, 279; 277/88, 92; 239/230–233, 546

[56] References Cited

U.S. PATENT DOCUMENTS

| | | | |
|---|---|---|---|
| 68,712 | 9/1867 | Crook | 239/546 |
| 733,618 | 7/1903 | Brachhausen | 239/546 X |
| 851,603 | 4/1907 | Long | 239/546 |
| 2,101,938 | 12/1937 | Giberson | 285/279 X |
| 2,944,743 | 7/1960 | Kachergis | 239/546 X |
| 2,986,410 | 5/1961 | Norland | 239/230 X |
| 3,743,183 | 7/1973 | Malcolm | 239/230 X |
| 3,764,073 | 10/1973 | Costa et al. | 239/230 |
| 3,937,494 | 2/1976 | Hicks | 285/281 |

*Primary Examiner*—Johnny D. Cherry
*Assistant Examiner*—Michael J. Forman
*Attorney, Agent, or Firm*—Klarquist, Sparkman, Campbell, Leigh, Whinston & Dellett

[57] ABSTRACT

The specification discloses irrigation sprinklers of the impact type each including a nozzle having a slotted end portion on which is screwed a camming nut which is adjustable to contract the end portion of the nozzle to provide a smaller stream. Locking lips on the end of the nozzle overhang the nut to prevent accidental removal thereof. Bodies of the sprinklers are supported by flanged, barrel-like sleeves of polytetrafluoroethylene act both as a thrust bearing and a spring and as a water seal, the sleeve being composite and having top and bottom frustoconical rings with a tube extending therebetween.

6 Claims, 8 Drawing Figures

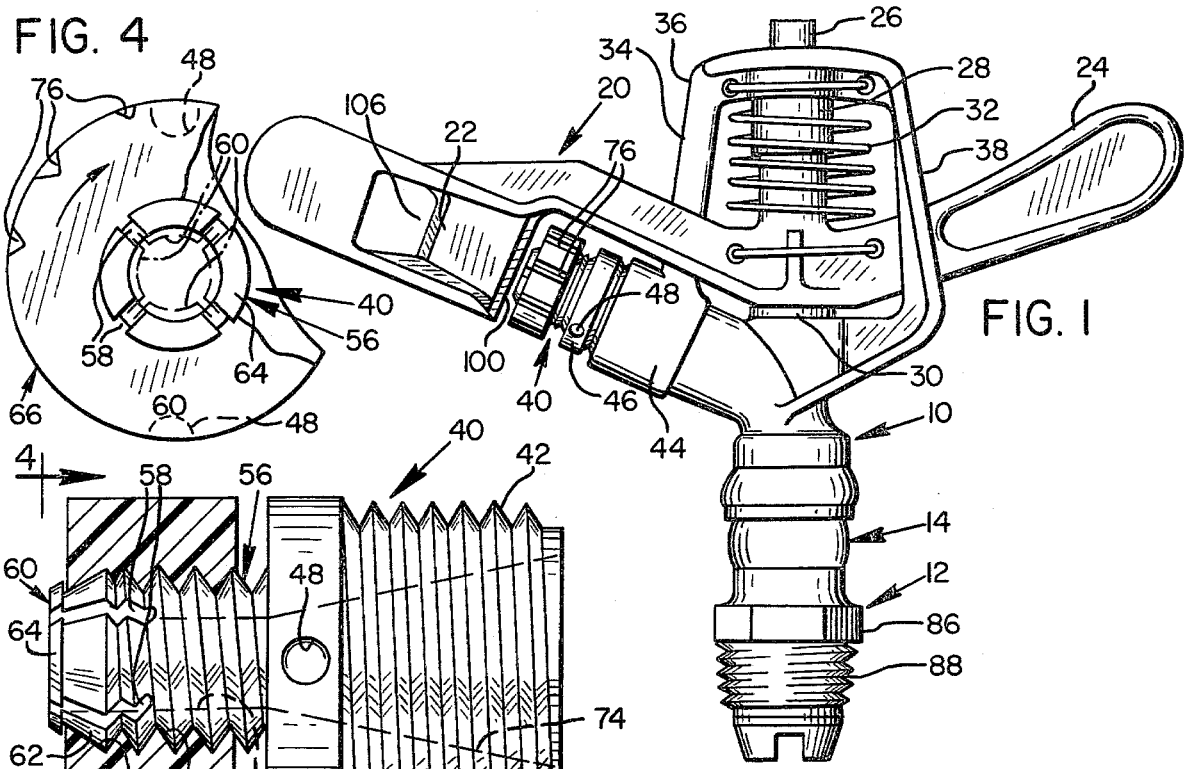
FIG. 4
48
76
60
58
64
66
60
48
40
56
106
22
20
76
100
40
46
44
48
34
36
26
28
32
38
24
30
10
14
12
86
88
FIG. 1
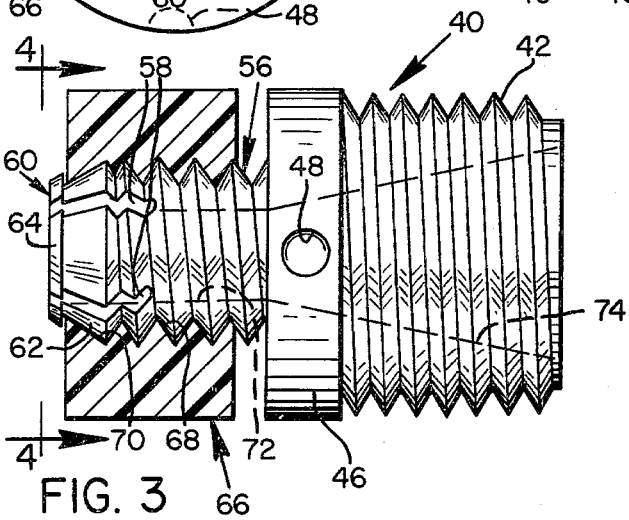
4
58
56
40
42
60
64
48
62
74
4
70
68
72
66
46
FIG. 3
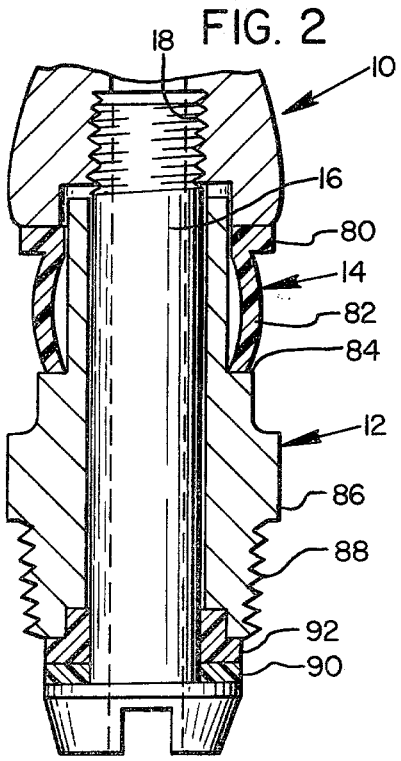
FIG. 2
18
10
16
80
14
82
84
12
86
88
92
90
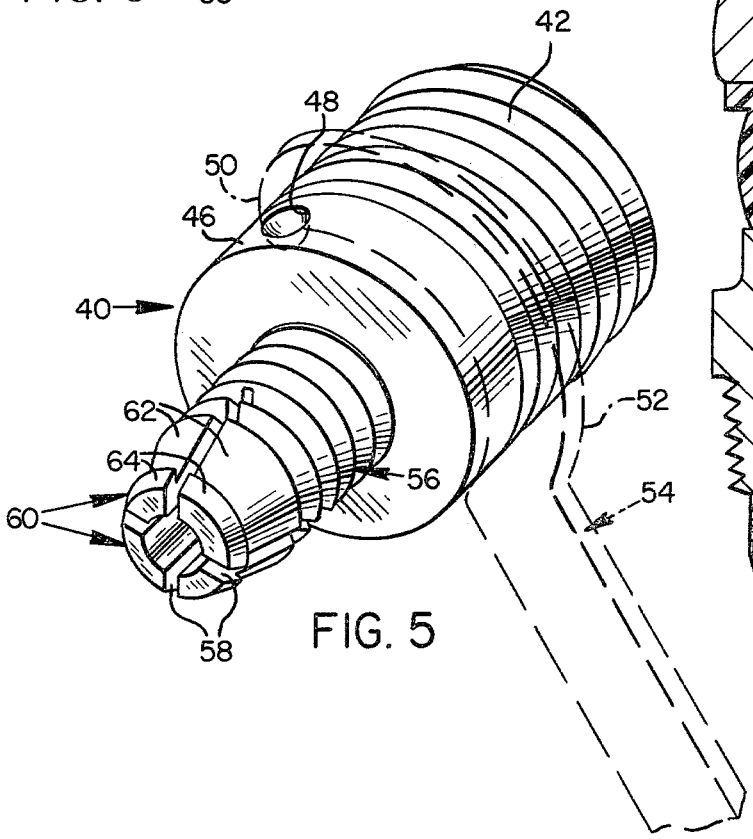
42
48
50
46
40
62
64
60
58
56
52
54
FIG. 5

FIG. 6
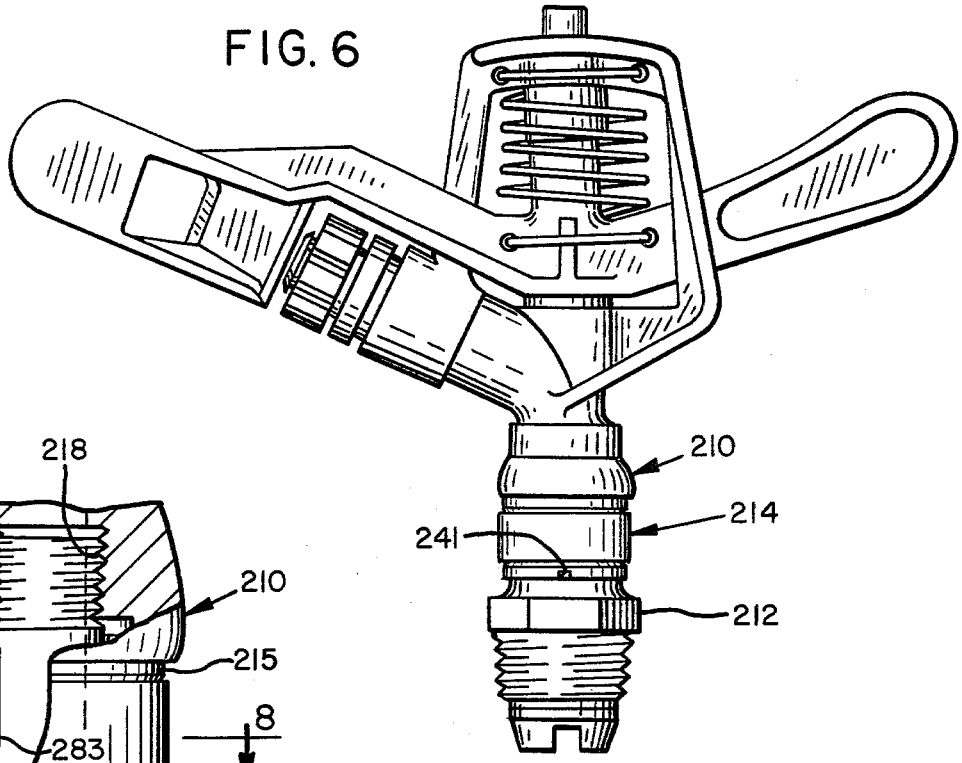
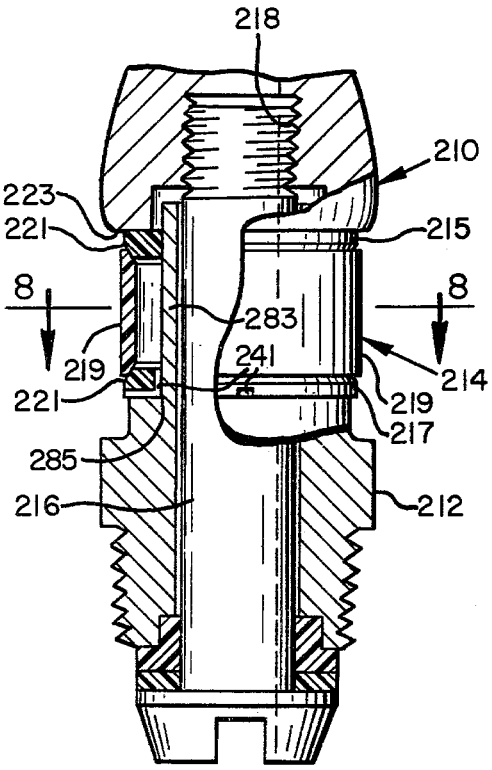
FIG. 7
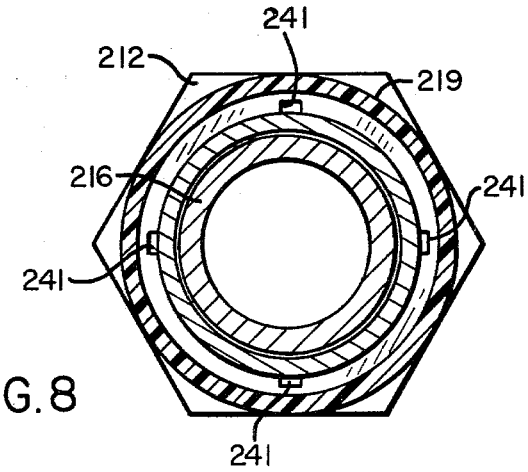
FIG. 8

IRRIGATION SPRINKLERS

RELATED APPLICATION

This application is a continuation-in-part of my copending application, Ser. No. 786,987, filed Apr. 13, 1977 now abandoned.

DESCRIPTION

This application relates to improved irrigation sprinklers, and has for an object thereof the provision of new and improved irrigation sprinklers.

Another object of the invention is to provide an irrigation sprinkler having a nozzle that is easily adjusted over a wide range of jet streams.

A further object of the invention is to provide an irrigation sprinkler having a collet-like nozzle and an adjusting nut screwed onto the end of the nozzle to contract the nozzle as desired, the slots in the nozzle providing feathered auxiliary streams.

Another object of the invention is to provide an irrigation sprinkler having an adjusting nut retained on a collet-like nozzle by an overhanging locking lip on the nozzle.

Another object of the invention is to provide an irrigation sprinkler having a body screwed onto a swivel sleeve with a flanged, barrel-like spring bearing of low friction material positioned between the body and a bearing housing.

Another object of the invention is to provide an irrigation sprinkler having a body screwed onto a swivel sleeve with a combined seal and spring between the body and a bearing housing, the spring being a cylindrical tube between two frustoconical rings.

In the Drawings:

FIG. 1 is an elevational view of an improved irrigation sprinkler forming one embodiment of the invention;

FIG. 2 is an enlarged, fragmentary, vertical, sectional view of the sprinkler of FIG. 1;

FIG. 3 is an enlarged, partially sectional, elevational view of a novel nozzle of the sprinkler of FIG. 1;

FIG. 4 is an end view taken along line 4—4 of FIG. 3;

FIG. 5 is an enlarged, perspective view of the nozzle of FIG. 3 with a wrench thereon;

FIG. 6 is an elevational view of an improved irrigation sprinkler forming an alternate embodiment of the invention;

FIG. 7 is an enlarged, fragmentary, vertical, sectional view of an improved irrigation sprinkler forming an alternate embodiment of the invention; and FIG. 8 is an enlarged, horizontal, sectional view taken along line 8—8 of FIG. 7.

An improved irrigation sprinkler forming a specific embodiment of the invention includes a body 10 mounted rotatably on a bearing housing 12 by a resilient, barrel-like, flanged, spring sleeve 14 and a nipple or swivel tube 16 screwed into a tapped bore 18 in the body 10. The sprinkler is of the impact type and, except for differences brought out below, is like that shown in U.S. Pat. No. 2,946,517. An arm 20 having a knife-edged impact plate portion 22 and a counterbalancing arm 24, is mounted for oscillation on a post 26 carried rigidly by the body between low friction thrust washers 28 and 30. A torsion spring 32 fixed at its upper end to the body and at its lower end to the arm 20 biases the arm toward engagement with a face 34 of a vertical member 36 of the body and the hidden or rear (as shown in FIG. 1) face of member 38 of the body.

A generally collet-like nozzle 40 has an externally threaded connecting portion 42 screwed sealingly into a tapped bore in angular, tubular portion 44 of the body 10. The nozzle has an integral driving ring 46 having two radial sockets 48, each being adapted to receive a pin portion 50 of an arcuate head 52 of a wrench 54. The nozzle has an externally threaded tubular portion 56 having four slits 58 for about half its length to form spring fingers 60. Camming surfaces 62 forming parts of a conical frustum are positioned just behind overhanging, ratchetlike, tapered locking lips 64, which overhang outer end of locking nut 66 having a tapped portion 68 and a frustoconical camming portion 70. The nozzle has a cylindrical outer bore portion 72 with a tapered bore portion 74 leading thereto. As best shown in FIG. 4, with the nut positioned at the ratchet-like locking lip, the exit of orifice of the nozzle is wide open. However, the nut, which is grooved externally to provide a good grip and indexing, may be screwed farther onto the nozzle to contract the fingers 60 to any desired contracted positions, one contracted orifice condition being illustrated by broken-line positions of the fingers 60, shown in FIG. 4. The nut has grooves 76 and the uppermost socket 48 serves as a pointer to indicate the condition of adjustment of the orifice by which groove 76 is adjacent the pointer. The flow of water under pressure aids in maintaining the set orifice size. The nozzle may be of a springy metal, polyurethane, lexan, or black nylon or other suitable tough springy material. The slots 58 give not only adjustment of the orifice size but also give four feather streams and help the sprinkler drive when the water pressure is low.

The spring sleeve or bearing sleeve collar 14 (FIGS. 1 and 2) preferably is of a low friction elastomeric material, such as, for example, polytetrafluoroethylene. A flange 80 serves as a low friction support for the tubular lower end portion of the body and seals thereagainst. The sleeve has a barrel-like spring portion 82 and a lower end seating sealingly on shoulder 84 of the bearing housing 12. The housing has a hexagonal drive portion 86 and a threaded connecting portion 88. A bearing washer 90 and a wearing ring 92 also are provided. The bearing sleeve collar 14 replaces two top seal washers and a spring, and helps in preventing abrasion between the bearing nipple 16 and the bearing sleeve 14 from sand, grit, etc. The bearing sleeve collar 14 assists the rotation of the body 10 due to its low friction contact therewith.

The sockets 48 are 180° apart along a line bisecting the angle between the upper two of slots 58 and also bisecting the angle between the lower two of the slots 58. In practice, the nozzle 40 is screwed in until tight and one of the sockets 48 is at the very top. This positions the two lower slots 45° from the bottom and prevents streams therefrom from washing the ground therebelow.

EMBODIMENT OF FIGS. 6–8

An improved irrigation sprinkler forming an alternate embodiment of the invention is like the sprinkler of FIGS. 1–5 except for a sleeve 214. The sprinkler of FIGS. 6–8 includes a body 210 mounted rotatably on the bearing housing 212 by the sleeve 214 and a swivel tube 216 screwed into a tapped bore 218 in the body 210. The sleeve 214 includes top and bottom rings 215 and 217 identical in shape and a spring tube 219 into which frustoconical nose portions 221 of the rings extend. The bottom ring 217 preferably has four L-shaped draining grooves 241 to let interior water out of the sleeve. The rings fit closely on a sleeve portion 283 of the bearing housing 212, and the bottom ring wedges onto a fillet portion 285 of the bearing housing. The ends of the sleeve 214 are beveled to partially receive the tapered rings. A body 210 is screwed onto a bearing nipple 216. The spring tube 219 is preferably of a tough polyethylene or polypropolyene, and the rings 215 and 217 preferably are of a tough, molded nylon, and the ring 215 preferably is color coded a color different from that of the ring 217. Also, the upper ring 215 preferably is impregnated with a lubricant. The ring 215 sealingly engages an annular end 223 of the body 210 and the ring 217 sealingly engages the fillet. The tube portion 219 sealingly wedges on the rings. The outer taper of the rings extends into the tube and prevents the rings from accidentally coming out of the sleeve.

What is claimed is:

1. In a swiveled irrigation sprinkler, a vertical bearing housing having an upwardly facing annular shoulder, a swivel tube rotatable in the bearing housing, seal means at the lower end of the housing between the swivel tube and the housing, a sprinkler body secured to the upper end of the swivel tube and having an annular shoulder facing the first-mentioned annular shoulder, a thin walled cylindrical tube loosely surrounding the housing and forming a spring sleeve of low friction material, an upper wedge ring having a tapered portion extending into the upper end portion of the sleeve and engaging the annular shoulder of the body, and a lower wedge ring engaging the shoulder of the housing and having a tapered portion extending into the lower end portion of the sleeve.

2. The sprinkler of claim 1 wherein the lower wedge ring has drainage grooves therein.

3. In an improved sprinkler nozzle structure, a tubular nozzle having a discharge portion having segments defining a generally cylindrical orifice at its discharge end, and adjustment means for pressing the segments inwardly to conical form to constrict the orifice, the segments being spaced circumferentially from each other to define wedge-shaped auxiliary orifice slots and having cam surfaces, the adjustment means comprising a nut screwed onto the nozzle and having a ring-like actuator portion engaging the cam surfaces, the nozzle comprising a tube having the discharge end portion thereof longitudinally slotted to define the segments and having an externally threaded portion to receive the nut, the slots extending from a point within the nut outward beyond the nut, the nozzle having an unslotted cylindrical entrance portion of a predetermined internal diameter, the discharge portion being of a substantially lesser internal diameter than said predetermined diameter, the nozzle having a tapered transition portion connecting the entrance portion and the discharge portion, the nut covering the major portion of the length of the segments.

4. In an improved sprinkler nozzle structure, a tubular nozzle having segments defining an orifice at its discharge end, and adjustment means for pressing the segments inwardly to decrease the orifice, the segments being spaced circumferentially from each other to define auxiliary orifice slots, the segments having cam surfaces, the adjustment means comprising a nut screwed onto the nozzle and having a ring-like actuator portion engaging the cam surfaces, the slots extending beyond the nut, the nozzle comprising a tube having the discharge end portion thereof longitudinally slotted to define the segments and having an externally threaded portion to receive the nut, the nut having an internal frustoconical end portion for engaging the cam surfaces, at least one of the segments having a stop shoulder at the end thereof to prevent the nut from accidentally coming off the nozzle.

5. The nozzle structure of claim 4 wherein the nozzle is a nipple-like member having a second threaded portion spaced from the first-mentioned threaded portion.

6. The nozzle structure of claim 5 wherein the nozzle has a driving portion between the first-mentioned threaded portion and the second threaded portion.

* * * * *